United States Patent [19]

DeRosa et al.

[11] Patent Number: 4,973,413

[45] Date of Patent: Nov. 27, 1990

[54] MULTIFUNCTIONAL VISCOSITY INDEX IMPROVER ADDITIVE AND LUBRICATING OIL COMPOSITION CONTAINING SAME

[75] Inventors: Thomas F. DeRosa, Passaic, N.J.; Benjamin J. Kaufman, Hopewell Junction, N.Y.; Edward F. Miller, Wappingers Falls, N.Y.; Rosemary J. Jennejahn, Nelsonville, N.Y.

[73] Assignee: Texaco Inc., White Plains, N.Y.

[21] Appl. No.: 457,218

[22] Filed: Dec. 26, 1989

[51] Int. Cl.[5] ..... C10M 147/00; C10M 149/02

[52] U.S. Cl. ..... 252/51.5 R; 252/51

[58] Field of Search ..... 252/51.5 R, 51

[56] References Cited

U.S. PATENT DOCUMENTS

| | | | |
|---|---|---|---|
| 4,051,050 | 9/1977 | Elliott et al. | 252/51.5 R |
| 4,098,710 | 7/1978 | Elliott et al. | 252/51.5 R |
| 4,194,984 | 3/1980 | Elliott et al. | 252/51.5 R |

*Primary Examiner*—Olik Chaudhuri

*Assistant Examiner*—E. McAvoy

*Attorney, Agent, or Firm*—Robert A. Kulason; James J. O'Loughlin; Vincent A. Mallare

[57] ABSTRACT

A polymeric lubricating oil additive containing pendant perfluoroaliphatic urethane units that behaves as a VI Improver and a fuel economy enhancer when added to lubricating oil compositions. The polymeric substrate may be a copolymer of 15–85 mole % ethylene and propylene or a terpolymer of 15–85 mole % ethylene, propylene, and 20–80 mole % of a non-conjugated diene or triene ($C_3$–$C_{10}$) alpha olefin. The copolymer or terpolymer substrate has a molecular weight range of about 5,000 to about 500,000. A graft copolymer or terpolymer containing pendant isocyanate groups is prepared by reacting the ethylene propylene co- or terpolymer with an acrylating agent. Post-reacting the copolymer or terpolymer containing the pendant isocyanate group with a perfluoroaliphatic alcohol generates the additive.

14 Claims, No Drawings

MULTIFUNCTIONAL VISCOSITY INDEX IMPROVER ADDITIVE AND LUBRICATING OIL COMPOSITION CONTAINING SAME

BACKGROUND OF THE INVENTION

This invention relates to a novel lubricant additive acting as a viscosity index improver (VII) and imparting enhanced fuel economy when employed in a lubricating oil composition.

The addition of oligomeric waxes or oils of polytetrafluoroethylene (PTFE) to lubricating oils is designed to reduce wear and friction on mechanized components of internal combustion engines. Less frequent replacement of worn or damaged engine components and greater gasoline efficiency are direct consequences. PTFE oils or waxes are not, however, soluble in any known lubricating oil.

Thus, it is an object of the present invention to provide a method of enhancing fuel economy in internal combustion engines by chemically incorporating oligomeric perfluoroaliphatic grafts onto ethylene-propylene copolymers or ethylene-propylene terpolymers. By incorporating these perfluoroaliphatic appendages, the ethylene-propylene copolymers or ethylene-propylene terpolymers are soluble in lubricating oils.

DISCLOSURE STATEMENT

U.S. 3,933,656 discloses a method of friction reduction between metal surfaces using a dispersion of polytetrafluoroethylene in lubricating oil.

U.S. 4,224,173 discloses a method of using polytetrafluoroethylene dispersions in lubricating oils to reduce friction and enhance fuel economy in internal combustion engines.

U.S. 4,284,518 discloses a method of using a colloidal dispersion of polytetrafluoroethylene as a wear resistant additive and fuel economizer during physical operation.

The disclosures in the foregoing patents which relate to VI improvers and fuel economizers for lubricating oils, namely U.S. Pat. Nos. 3,933,656, 4,224,173, and 4,284,518 are incorporated herein by reference.

SUMMARY OF THE INVENTION

The novel reaction product of the invention comprises a chemical modification of an ethylene-propylene copolymer or terpolymer. The terpolymer is typically a $C_2$ to $C_{10}$ alphaolefin and optionally a non-conjugated diene or triene. The novel lubricant of this invention comprises an oil of lubricating viscosity and an effective amount of the novel reaction product. The lubricating oil will be characterized as behaving as a viscosity index improver with enhanced fuel economy properties.

The invention comprises a chemical modification of an ethylene-propylene copolymer or terpolymer by chemically incorporating 2-isocyanoethylacrylate (I) onto the polymeric substrate and then $$CH_2{=}CH_2{-}CO{-}OCH_2CH_2{-}NCO \quad (I)$$

(2-isocyanoethylacrylate)

further derivatizing using a perfluoroaliphatic alcohol.

Perfluoroaliphatic alcohols (II) that can be used in the derivation process are those materials that contain the perfluoroaliphatic unit and are represented by the following formula:

$$CF_3{-}(CF_2)a{-}(CH_2)b{-}OH \quad (II)$$

(Perfluoroaliphatic alcohol)

in which the difluoro repeat unit, e.g., a, has a range of 1 to 20, and the hydrocarbon repeat unit, e.g., b, has a range of 2 to 10.

DETAILED DESCRIPTION OF THE INVENTION

The present method of enhancing fuel economy in internal combustion engines is by chemically incorporating oligomeric perfluoroaliphatic grafts onto ethylene-propylene copolymers or ethylene-propylene terpolymers.

This method offers distinct advantages over other methods that utilize perfluorooligomers in lubricating oils. Firstly, ethylene-propylene copolymers and terpolymers containing chemically grafted perfluorooligomers are completely soluble in a wide variety of solvents, including lubricating oils. This permits antifriction properties to be imparted to the lubricating oils in a wide variety of temperatures and engine operating conditions. Secondly, the grafting methodology has application to polymers other then those with ethylene-propylene backbones.

The polymer or copolymer substrate employed as the novel additive of the invention may be prepared from ethylene or propylene or it may be prepared from ethylene and a higher olefin, which are typically $C_3$ to $C_{10}$ alpha-olefins.

More complex polymer substrates, often designated as interpolymers, may be prepared using a third component. The third component generally used to prepare an interpolymer substrate is a polyene monomer selected from non-conjugated dienes and trienes. This non-conjugated diene component typically has from 5 to 14 carbon atoms in the chain.

The diene monomer can include acyclic, cyclic, or bicyclic compounds. Representative dienes include 1,4-hexadiene. 1,4-cyclohexadiene, dicyclopentadiene, 5-ethylidene-2-norbornene, 5-methylene-2-norborene, 1,5-heptadiene and 1,6 octadiene. A mixture of more than one diene can be used in the preparation of the interpolymer. A preferred non-conjugated diene for preparing a terpolymer or interpolymer substrate is 1,4-hexadiene.

The triene component will have at least two nonconjugated double bonds, and up to about 30 carbon atoms in the chain. Typical trienes useful in preparing the interpolymer of the invention are 1-isopropylidene-3a,4,7,7a-tetrahydroindene, 1-isopropylidenedicyclopentadiene, dehydroisodicyclopentadiene, and 2-(2-methylene-4-methyl-3-pentenyl)-[2.2.1]bicyclo-5-heptene.

The polymerization reaction to form the polymer substrate is generally carried out in the presence of a catalyst in a solvent medium. The polymerization solvent may be any suitable inert organic solvent that is liquid under reactions conditions for solution polymerization of monoolefins which is generally conducted in the presence of a Ziegler-Natta type catalyst. Examples of satisfactory hydrocarbon solvents include straight chain paraffins having from 5–8 carbon atoms, with hexane being preferred. Aromatic hydrocarbon, preferably aromatic hydrocarbon having a single benzene nucleus, such as benzene, toluene and the like or saturated cyclic hydrocarbons having boiling point ranges approximating those of the straight chain paraffinic hydrocarbons and aromatic hydrocarbons described above, are particularly suitable. The solvent selected may be a mixture of one or more of the foregoing hydrocarbons. It is desirable that the solvent be free of substances that will interfere with the Ziegler-Natta polymerization process.

In a typical preparation of the polymer substrate, hexane is first introduced into a reactor and the temperature in the reactor is raised moderately to about 30° C. Dry propylene is fed to the reactor until the pressure reaches about 40-45 inches of mercury. The pressure is then increased to about 60 inches of mercury and dry ethylene and 5-ethylidene-2-norbornene are fed to the reactor. The monomer feeds are stopped and a mixture of aluminum sesquichloride and vanadium oxytrichloride are added to initiate the polymerization reaction. Completion of the polymerization reaction is indicated by a pressure drop in the reactor.

Ethylene-propylene copolymers or ethylene-propylene and higher alpha monoolefin terpolymers may consist of from about 15 to 80 mole percent ethylene and from about 20 to 85 mole percent propylene or higher monoolefin with the preferred mole ratios being from about 50 to 80 mole percent ethylene and from about 20 to 50 mole percent of a $C_3$ to $C_{10}$ alpha monoolefin with the most preferred proportions being from 55 to 80 mole percent ethylene and 20 to 75 mole percent propylene, and having a number average molecular weight of about 5,000 to 500,000.

Terpolymer variations of the foregoing polymers may contain from about 0.1 to 10 mole percent of a non-conjugated diene or triene.

The polymer substrate, that is the ethylene-propylene copolymer or terpolymer is an oil-soluble, substantially linear, rubbery material having a number average molecular weight of about 5,000 to 500,000 with a preferred number average molecular weight of about 25,000 to 250,000 and a most preferred range of about 50,000 to 150,000.

The terms polymer and copolymer are used generically to encompass ethylene-propylene copolymers, terpolymers or interpolymers. These materials may contain minor amounts of other olefinic monomers so long as their basic characteristics are not materially changed.

The 2-isocyanoethylacrylate may be grafted onto the polymer backbone in a number of ways. It may be grafted onto the backbone by a thermal process known as the "ene" process or by grafting in solution using a free radical initiator. The free-radical induced grafting of substituted acryamides in non-polar solvents containing 5–9 carbon atoms or monoaromatic solvents, benzene being the preferred method. It is carried out in an inert atmosphere at an elevated temperature in the range of about 100° C. to 250° C., preferably 120° C. to 190° C., and more preferably at 150° C. to 180° C., e.g. above 160° C., in a hydrocarbon solvent, preferably a mineral lubricating oil solution, containing, e.g., 1 to 50 weight percent polymer, preferably 20 to 40 weight percent.

The free radical initiators which may be used are peroxides, hydroperoxides, and azo compounds and preferably those which have a boiling point greater than 100° C. and decompose thermally within the grafting temperature range to provide free radicals. Representative of these free radical initiators are dicumylperoxide and 2,5-dimethyl-hex-3-yne-2,5-bis tertiary-butyl peroxide. The initiator is used in an amount of between 0.005% and about 2% by weight based on the weight of the reaction mixture solution. The grafting is preferably carried out in an inert atmosphere, for instance nitrogen. The resulting polymer is characterized as having pendant 2-isocyanoethylacrylate functions within its structure.

The polymer intermediate possessing a pendant 2-isocyanoethylacrylate function is reacted with perfluoroaliphatic alcohols represented by the following formula:

$$CF_3—(CF_2)a—(CH2)b—OH \quad (III)$$

in which the perfluoro repeat unit, e.g., a, varies from 1 to 20 and the hydrocarbon repeat unit, e.g., b, varies from 2 to 10.

The perfluoroaliphatic alcohol may be a perfluoroaliphatic-1,1,2,2-tetra-H-ethyl alcohol having a molecular weight range of about 440 to about 525, and preferably an average molecular weight of about 475.

Examples of perfluoroaliphatic alcohols are those materials where the average perfluoroalkyl chain length is 7.3, or 8.2, or 9.0 while the hydrocarbon repeat unit may vary from 2 to 10, 2 being the preferred number. Perfluoroaliphatic alcohols with average perfluoroalkyl chain lengths of 7.3, 8.2, and 9.0 consist of mixtures of perfluoroalkyl chains, the weight percentages of which are described in Table I. They are available commerically under the tradenames of Zonyl BA-L, ZONYL BA, and ZONYL BA-N, respectively, and are available from E. I. DuPont deNemours and Co of Wilmington, Delaware.

In Table I, below, the weight percentages are provided of perfluoroalkyl chains present in perfluoroaliphatic alcohols.

TABLE I

| Fluoroalkane Chain | ZONYL BA-L (wt %) | ZONYL BA (wt %) | ZONYLBA-N (wt %) |
|---|---|---|---|
| C4F9 | 4 max | 4 max | 0 |
| C6F13 | 50 3 | 35 3 | 6 max |
| C8F17 | 29 2 | 30 3 | 50 3 |
| C10F21 | 11 2 | 17 2 | 29 2 |
| C12F25 | 4 1 | 8 1 | 11 2 |
| C14F29 and higher | 2 max | 6 max | 4 max |

The reaction between the polymer substrate containing pendant 2-isocyanoethylacrylate and the prescribed perfluoroaliphatic alcohol is conducted by heating a solution of the polymer intermediate under inert conditions and then adding the perfluoroaliphatic alcohol with stirring to effect the reaction. It is convenient to employ an oil solution of the polymer substrate heated to 140° to 175° C. while maintaining the solution under a nitrogen blanket. One of the perfluoroaliphatic alcohols with an average perfluoroalkyl repeat unit of 7.3, 8.2, or 9.0 is added to this solution and the reaction is effected under these conditions. The following examples illustrate the preparation of the novel reaction product additive of this invention.

EXAMPLE I

Preparation of OCP-g-2-isocyanoethylacrylate

Two hundred grams of polymeric substrate consisting of about 60 mole percent ethylene and 40 mole percent propylene and having a number average molecular weight of 80,000 was dissolved in 1440 grams of solvent neutral oil at 160° C. using a mechanical stirrer while the mixture was maintained under a blanket of nitrogen. After the rubber was dissolved, the mixture was heated an additional hour at 160° C. Eleven grams of 2-isocyanoethylacrylate are dissolved in 10 grams of solvent neutral oil and added to the above mixture along with 2.5 grams of dicumyl peroxide also dissolved in 10 grams of oil. The mixture reacted for 2.5 hours at 160° C. then filtered through a 200 mesh screen.

EXAMPLE II

Reaction of OCP-g-2-isocyanoethylacrylate with perfluoroaliphatic alcohol

Twenty six grams of the aforementioned graft copolymer was dissolved in 174 grams of solvent neutral oil at 160° C. using mechanical stirring under a nitrogen blanket. Perfluoroaliphatic alcohol (3.4 grams) with a perfluoroaliphatic repeat unit of 9.0 was added neat to the mixture and the reaction heated for an additional hour under the aforementioned conditions. The mixture was then cooled to 120° C. and filtered through a 200 mesh filter.

EXAMPLE III

Reaction of OCP-g-2-isocyanoethylacrylate with perfluoroaliphatic alcohol 2.8g of perfluoroaliphatic alcohol with a perfluoroaliphatic repeat unit of 8.2 may be substituted in the aforementioned procedure.

EXAMPLE IV

Reaction of OCP-g-2-isocyanoethylacrylate with perfluoroaliphatic alcohol 2.2g of perfluoroaliphatic alcohol with a perfluoroaliphatic repeat unit of 7.3 may be substituted in the aforementioned procedure.

The novel graft and derivatized polymer of the invention is useful as an additive for lubricating oils that is designed to enhance the fuel economy in internal combustion engines. It can be employed in a variety of oils of lubricating viscosity including natural and synthetic base oils and mixtures thereof. The novel additives can be employed in crankcase lubricating oils for spark-ignited and compression-ignited internal combustion engines. The compositions can also be used in gas engines, or turbines, automatic transmission fluids, gear lubricants, metal-working lubricants, hydraulic fluids, and other lubricating oil and grease compositions. Their use in motor fuel compositions is also contemplated.

The base oil may be a natural oil including liquid petroleum oils and solvent-treated or acid-treated mineral lubricating oils of the paraffinic, naphthenic and mixed paraffinic-naphthenic types.

In general, the lubricating oil composition of the invention will contain the novel reaction product in a concentration ranging from about 0.1 to 30 weight percent. A preferred concentration range for the additive is from about 1 to 15 weight percent based on the total weight of the oil composition.

Oil concentrates of the additive may contain from about 1 to 50 weight percent of the additive reaction product in a carrier or diluent oil of lubricating oil viscosity.

The novel product of this reaction may be employed in lubricating oil compositions together with conventional lubricant additives. Such additives may include dispersants, detergents, anti-oxidants, pour point depressants and the like.

The novel product of this invention was tested for its effectiveness as a fuel economy agent in a fully formulated lubricating oil composition in a 12.5 wt% concentrate. Table II provides a description of the two components used to prepare this concentrate.

TABLE II

| Component | Parts by Weight |
|---|---|
| Solvent Neutral Oil A | 100 |
| Product | 12.50 |

Oil A has a sp. gr. 60/60° F. of 0.858–0.868; Vis. @ 100° F. of 123–133 cPs; Pour-Point is 0° F.

Energy conserving properties of the novel additive were evaluated using the ASTM Sequence VI Gasoline Fuel Efficient Oil Test. This test evaluates the energy conserving propertities of oil formulations and provides an Equivalent Fuel Economy Index (EFEI) for the energy conserving propertities of the formulation. The higher the EFEI the greater the energy conserving propertities of the formulation. Oil formulations containing the experimental polymer were prepared without friction modifiers; a typical formulation is provided in Table III.

TABLE III

| Material | Wt Percent |
|---|---|
| Experimental Base Blend | 85.0 |
| Texaco SNO-100 | 5.0 |
| Texaco - 7200 A | 9.0 |
| Experimental Friction (12 wt % concentrate) | 1.0 |

The Experimental Base Blend consisted of Base oil and a DI package. The components of the DI package are provided below in Table IV.

TABLE IV

| DI PACKAGE USED IN EXPERIMENTAL BASE BLEND | |
|---|---|
| Component | Parts by Weight |
| 4,4'dinonyldiphenylamine | .39 |
| Overbased magnesium sulfonate | 1.50 |
| Silicone anifoamant | 150 PPM |

Two other perfluoaoaliphatic monomers were chemically grafted to the OCP rubber and evaluated by the Sequence VI Test. Each material contained approximately the same perfluoroaliphatic repeat unit but did not contain a urethane bond. This was performed to underscore the importance of incorporating pendant perfluoroaliphatic groups using a urethane linkage. Sequence VI Testing was also performed using mixtures of perfluoroaliphatic alcohols mixtures containing perfluoroaliphatic alcohols and OCP rubber. This was performed to demonstrate that independent of the chemical moiety used to graft the perfluoroaliphatic alcohol, only chemical grafting can ensure enhanced fuel economy. Moreover, the mixture containing the perfluoroaliphatic alcohol dramatically demonstrated the inefficiency of perfluorooligomeric dispersions. In Table V, below, the results are summarized of Sequence VI Testing using experimental friction modifiers.

TABLE IV

| Polymer Additive | Equivalent Fuel Economy Index (%) |
|---|---|
| Unmodified ethylene-propylene copolymer | 2.90 |
| Perfluoroaliphatic urethane graft | 4.22 |
| Perfluoroaliphatic alkene graft | 2.89 |

TABLE IV-continued

| Polymer Additive | Equivalent Fuel Economy Index (%) |
|---|---|
| Perfluoroaliphatic alcohol mixture | 0.90 |

The results from the Sequence VI Test show that enhanced fuel economy is obtained by a unique combination of perfluoroaliphatic groups grafted to ethylene-propylene copolymers using a urethane bond.

We claim:

1. A lubricating oil composition comprising a major amount of an oil of lubricating viscosity and a minor amount of a lubricant additive prepared by the steps comprising:

a) preparing a polymer based on ethylene and at least one ($C_3$–$C_{10}$) alpha-monoolefin and optionally a polyene selected from non-conjugated dienes and trienes comprising from about 15 to 80 mole percent of ethylene from about 20 to 85 mol percent of said ($C_3$–$C_{10}$) alpha-monoolefin and from about 0 to 15 mole percent of said polyene and having a number average molecular weight ranging from about 5,000 to 500,000;

b) reacting said polymer with 2-isocyanoethylacrylate which is characterized by having a reactive pendant isocyanate group within its structure;

c) reacting said intermediate formed in step (b) with a perfluoroaliphatic alcohol group consisting of a unique weight average distribution of perfluoroaliphatic groups represented by the following formula:

$$CF_3—(CF_2)a—(CH_2)b\text{-}OH$$

wherein a ranges from 1 to 20 an b ranges from 2 to 10, said mixture being heated at 160° for 2.5 hours;

d) recovering the product lubricant additive composition.

2. A lubricating oil composition according to claim 1 wherein the perfluoroalcohol "a" unit is 7.3.

3. A lubricating oil composition according to claim 1 wherein the perfluoroalcohol "a" unit is 8.2.

4. A lubricating oil composition according to claim 1 wherein the perfluoroalcohol "a" unit is 9.0.

5. A lubricating oil composition according to claim 1 in which said polymer has a number average molecular weight of about 25,000 to 250,000.

6. A lubricating oil composition according to claim 1 in which said polymer has a number average molecular weight of about 50,000 to 150,000.

7. A lubricating oil composition according to claim 1 in which said polymer comprises from about 15 to 80 mole percent ethylene and from about 20 to 85 mole percent of a propylene and/or higher alpha-monoolefin.

8. A lubricating oil composition according to claim 1 in which said polymer comprises from about 50 to 80 mole percent ethylene and from about 20 to 50 mole percent propylene.

9. A lubricating oil composition according to claim 7 which contains from about 0.1 to 10 mole percent of a polyene.

10. A lubricating oil composition according to claim 8 wherein there is present from about 0.1 to about 10 weight percent of said polymer based on the total weight of the oil composition.

11. A lubricating oil composition according to claim 8 wherein there is present from about 0.5 to 1.5 weight percent of said polymer based on the total weight of the oil composition.

12. A lubricating oil composition according to claim 8 in which said perfluoroaliphatic alcohol is perfluoralkyl-1,1,2,2-tetra-H-ethyl alcohol with an average molecular weight of 443.

13. A lubricating oil composition according to claim 8 in which said perfluoroaliphatic alcohol is perfluoroalkyl-1,1,2,2-tetra-H-ethyl alcohol with an average molecular of 475.

14. A lubricating oil composition according to claim 8 in which said perfluoroaliphatic alcohol is perfluoroalkyl-1,1,2,2-tetra-H-ethyl alcohol with an average molecular of 514.

* * * * *